US009087443B2

(12) United States Patent
Bergman et al.

(10) Patent No.: US 9,087,443 B2
(45) Date of Patent: Jul. 21, 2015

(54) METHOD FOR BACKFIELD REDUCTION IN ELECTRONIC ARTICLE SURVEILLANCE (EAS) SYSTEMS

(71) Applicants: Adam S. Bergman, Boca Raton, FL (US); Manuel Soto, Lake Worth, FL (US)

(72) Inventors: Adam S. Bergman, Boca Raton, FL (US); Manuel Soto, Lake Worth, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 287 days.

(21) Appl. No.: 13/896,832

(22) Filed: May 17, 2013

(65) Prior Publication Data

US 2014/0111338 A1 Apr. 24, 2014

Related U.S. Application Data

(60) Provisional application No. 61/715,722, filed on Oct. 18, 2012.

(51) Int. Cl.
*G08B 23/00* (2006.01)
*G08B 13/24* (2006.01)

(52) U.S. Cl.
CPC ..... *G08B 13/2468* (2013.01); *G08B 13/2488* (2013.01)

(58) Field of Classification Search
CPC ..... G08B 23/00; G08B 13/184; H04Q 5/22; H04H 1/00
USPC ..... 340/572.7, 10.1, 572, 8.1; 455/41.2
See application file for complete search history.

(56) References Cited

U.S. PATENT DOCUMENTS

| | | | | |
|---|---|---|---|---|
| 4,686,513 | A | 8/1987 | Farrar | |
| 5,285,194 | A | 2/1994 | Ferguson | |
| 2010/0156599 | A1 * | 6/2010 | Ainsbury et al. | 340/10.1 |
| 2011/0109434 | A1 * | 5/2011 | Hadsall, Sr. | 340/8.1 |

FOREIGN PATENT DOCUMENTS

EP 0598988 A1 6/1994

OTHER PUBLICATIONS

EPO International Search Report dated Oct. 8, 2013 for corresponding appln PCT/US2013/041699.

* cited by examiner

*Primary Examiner* — Steven Lim
*Assistant Examiner* — Kaleria Knox
(74) *Attorney, Agent, or Firm* — Robert J. Sacco, Esq.; Carol Thorstad-Forsyth, Esq.; Fox Rothschild LLP

(57) ABSTRACT

Method for reducing undesired alarms in an electronic article surveillance (EAS) system involves measuring a tag response at a first and second pedestal to obtain contemporaneous first and second tag responses. The tag responses are compared to evaluate relative signal strength and thereby discern a lesser signal strength tag response. A reduced level exciter drive signal is applied to a selected one of the first and second pedestals associated with the lesser signal strength tag response. A detection zone is then monitored to determine the occurrence of a third tag response resulting from the reduced level exciter signal. The approximate location of the tag in relation to the first and second pedestals is determined based on the first, second, and third tag responses.

22 Claims, 7 Drawing Sheets

METHOD FOR BACKFIELD REDUCTION IN ELECTRONIC ARTICLE SURVEILLANCE (EAS) SYSTEMS

CROSS REFERENCE TO RELATED APPLICATIONS

This application is a non-provisional application of U.S. Provisional Application No. 61/715,722 filed on Oct. 18, 2012, which is herein incorporated in its entirety.

BACKGROUND OF THE INVENTION

1. Statement of the Technical Field

The invention relates generally to Electronic Article Surveillance ("EAS") systems, and more particularly to method for reduction of the backfield in EAS pedestal antenna systems.

2. Description of the Related Art

Electronic article surveillance (EAS) systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS system utilizes acousto-magnetic (AM) markers. The general operation of an AM EAS system is described in U.S. Pat. Nos. 4,510,489 and 4,510,490, the disclosure of which is herein incorporated by reference. The detection of markers in an acousto-magnetic (AM) EAS system by pedestals placed at an exit has always been specifically focused on detecting markers only within the spacing of the pedestals. However, the interrogation field generated by the pedestals may extend beyond the intended detection zone. For example, a first pedestal will generally include a main antenna field directed toward a detection zone located between the first pedestal and a second pedestal. When an exciter signal is applied at the first pedestal it will generate an electro-magnetic field of sufficient intensity so as to excite markers within the detection zone. Similarly, the second pedestal will generally include an antenna having a main antenna field directed toward the detection zone (and toward the first pedestal). An exciter signal applied at the second pedestal will also generate an electromagnetic field with sufficient intensity so as to excite markers within the detection zone. When a marker tag is excited in the detection zone, it will generate an electromagnetic signal which can usually be detected by receiving the signal at the antennas associated with the first and second pedestal.

It is generally desirable to direct all of the electromagnetic energy from each pedestal exclusively toward the detection zone between the two pedestals. As a practical matter, however, a certain portion of the electromagnetic energy will be radiated in other directions. For example, an antenna contained in an EAS pedestal will frequently include a backfield antenna lobe ("backfield") which extends in a direction which is generally opposed from the direction of the main field. It is known that markers present in the backfield of antennas associated with the first or second pedestal may emit responsive signals, and create undesired alarms.

Several techniques have been implemented in the past to eliminate alarms causes by the backfield. One approach involves configuring the antenna in each pedestal in a manner which minimizes the actual extent of the backfield. Other solutions can involve changing from the traditional dual-transceiver pedestal to a TX pedestal/RX pedestal system, alternating TX/RX modes, and physical shielding of the antenna pedestals. A further approach involves correlating video analytics with marker signals. An ideal solution to the backfield problem is one which does not alter the detection performance of a system in a negative manner. For instance, although a system in which only one pedestal transmits and the other pedestal receives can reduce undesired alarms, pedestal separation in such a system must be reduced to accomplish the desired backfield reduction.

SUMMARY OF THE INVENTION

The invention concerns a method for a reduction of undesired alarms in an electronic article surveillance (EAS) system which has at least two transceiver pedestals defining a detection zone between the pedestals. The method involves measuring a tag response at a first pedestal and at a second pedestal to obtain contemporaneous first and second tag responses. The first and second tag responses are respectively associated with the first and second pedestals. The first and second tag responses are then compared to evaluate their relative signal strength and thereby discern a lesser signal strength tag response. Based on this information, a reduced level exciter drive signal is set for a selected one of the first and second pedestals associated with the lesser signal strength tag response. Thereafter, the reduced level exciter drive signal is used at the pedestal associated with the lesser signal strength tag response to produce an electromagnetic exciter field in the detection zone. The detection zone is then monitored to determine the occurrence of a third tag response resulting from the reduced level exciter signal. A determination is then made as to the approximate location of the tag in relation to the first and second pedestals based on the first, second, and third tag responses. Notably, the reduced level exciter drive signal is reduced in power level as compared to an exciter signal used to obtain the contemporaneous first and second tag responses.

The invention also concerns an electronic article surveillance (EAS) system. The system includes first and second EAS transceiver pedestals, each including at least one exciter coil (which can also be understood as an antenna). A transmitter is configured to generate exciter signals which, when applied to at least one of the exciter coils, produce response signals from tags present in the detection zone. The system also includes at least one receiver which receives the response signals and at least one processor. The processor is programmed or otherwise configured to perform certain actions determine the approximate location of the tag in relation to the first and second pedestals. In particular, a tag response is received at the first pedestal and at the second pedestal to obtain contemporaneous first and second tag responses. The first and second tag responses respectively are associated with the first and second pedestals. The processor then compares the first and second tag responses to evaluate their relative signal strength and thereby determine a lesser signal strength tag response. The processor uses this information to set a reduced level exciter drive signal for a selected one of the first and second pedestals associated with a lesser signal strength tag response. The reduced level exciter drive signal is reduced in power level by the processor as compared to an exciter signal used to obtain the contemporaneous first and second tag responses. Once the reduced level exciter drive signal is selected, the processor causes the reduced level exciter drive signal to be applied to the at least one exciter coil. More particularly, the reduced level exciter drive signal is applied to the exciter coil at the pedestal associated with the lesser signal strength tag response so as to produce an electromagnetic exciter field in the detection zone. Subsequently, the processor will monitor an output of the at least one receiver to determine the occurrence of a third tag response resulting from the reduced level exciter signal. The processor will then determine the approximate location of the tag in relation to the first and second pedestals based on the first, second, and third tag responses.

BRIEF DESCRIPTION OF THE DRAWINGS

Embodiments will be described with reference to the following drawing figures, in which like numerals represent like items throughout the figures, and in which.

DETAILED DESCRIPTION OF THE INVENTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The implementation of the inventive system disclosed herein advantageously does not add new hardware or additional cost to the existing EAS systems. Since the solution can be software-implemented, it can also be readily ported to older systems to enhance their performance accordingly. The invention is described herein in terms of an AM EAS system, however the method of the invention can also be used in other types of EAS systems, including systems that use RF type tags and radio frequency identification (RFID) EAS systems.

The inventive system and method can identify the approximate location of a marker with sufficient granularity to determine if the marker is located between a pair of EAS pedestals, as opposed to a location which is behind one of the pedestals in the "backfield." By strategically varying the amplitude and phase of individual exciter coils (antennas) and monitoring the associated signal response produced by a marker, the approximate location of the marker can be determined. As such, the system and method described herein can reduce undesired alarms an EAS system having at least two transceiver pedestals, where a detection zone is defined between the pedestals.

Figure 1:
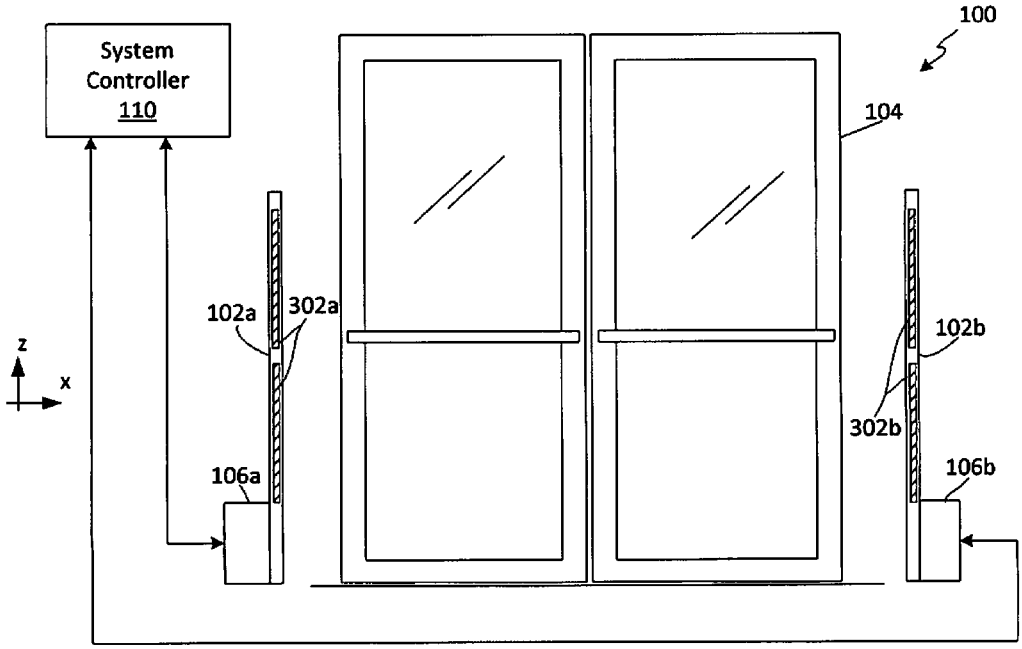
FIG. 1 is a side view of an EAS detection system, which is useful for understanding the invention.
Figure 2:
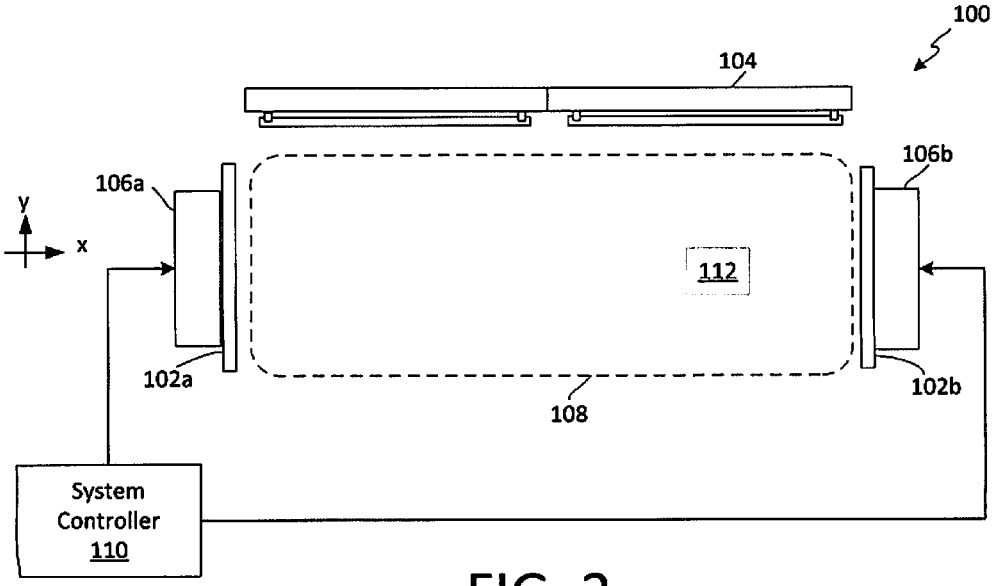
FIG. 2 is a top view of the EAS detection system in FIG. 1, which is useful for understanding an EAS detection zone.

Referring now to the drawings figures in which like reference designators refer to like elements, there is shown in FIGS. 1 and 2 an exemplary EAS detection system 100. The EAS detection system will be positioned at a location adjacent to an entry/exit 104 of a secured facility. The EAS system 100 uses specially designed EAS marker tags ("tags") which are applied to store merchandise or other items which are stored within a secured facility. The tags can be deactivated or removed by authorized personnel at the secure facility. For example, in a retail environment, the tags could be removed by store employees. When an active tag 112 is detected by the EAS detection system 100 in an idealized representation of an EAS detection zone 108 near the entry/exit, the EAS detection system will detect the presence of such tag and will sound an alarm or generate some other suitable EAS response. Accordingly, the EAS detection system 100 is arranged for detecting and preventing the unauthorized removal of articles or products from controlled areas.

A number of different types of EAS detection schemes are well known in the art. For example known types of EAS detection schemes can include magnetic systems, acousto-magnetic systems, radio-frequency type systems and microwave systems. For purposes of describing the inventive arrangements in FIGS. 1 and 2, it shall be assumed that the EAS detection system 100 is an acousto-magnetic (AM) type system. Still, it should be understood that the invention is not limited in this regard and other types of EAS detection methods can also be used with the present invention.

The EAS detection system 100 includes a pair of pedestals 102*a*, 102*b*, which are located a known distance apart (e.g. at opposing sides of entry/exit 104). The pedestals 102*a*, 102*b* are typically stabilized and supported by a base 106*a*, 106*b*. Pedestals 102*a*, 102*b* will each generally include one or more antennas that are suitable for aiding in the detection of the special EAS tags as described herein. For example, pedestal 102*a* can include at least one antenna 302*a* suitable for transmitting or producing an electromagnetic exciter signal field and receiving response signals generated by marker tags in the detection zone 108. In some embodiments, the same antenna can be used for both receive and transmit functions. Similarly, pedestal 102*b* can include at least one antenna 302*b* suitable for transmitting or producing an electromagnetic exciter signal field and receiving response signals generated by marker tags in the detection zone 108. The antennas provided in pedestals 102*a*, 102*b* can be conventional conductive wire coil or loop designs as are commonly used in AM type EAS pedestals. These antennas will sometimes be referred to herein as exciter coils. In some embodiments, a single antenna can be used in each pedestal and the single antenna is selectively coupled to the EAS receiver and the EAS transmitter in a time multiplexed manner. However, it can be advantageous to include two antennas (or exciter coils) in each pedestal as shown in FIG. 1, with an upper antenna positioned above a lower antenna as shown.

The antennas located in the pedestals 102*a*, 102*b* are electrically coupled to a system controller 110, which controls the operation of the EAS detection system to perform EAS functions as described herein. The system controller can be located within a base of one of the pedestals or can be located within a separate chassis at a location nearby to the pedestals. For example, the system controller 110 can be located in a ceiling just above or adjacent to the pedestals.

EAS detection systems are well known in the art and therefore will not be described here in detail. However, those skilled in the art will appreciate that an antenna of an acousto-magnetic (AM) type EAS detection system is used to generate an electro-magnetic field which serves as a marker tag exciter signal. The marker tag exciter signal causes a mechanical oscillation of a strip (e.g. a strip formed of a magnetostrictive, or ferromagnetic amorphous metal) contained in a marker tag within a detection zone 108. As a result of the stimulus signal, the tag will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone 304. As noted above, the same antenna contained in a pedestal 102*a*, 102*b* can serve as both the transmit antenna and the receive antenna. Accordingly, the antennas in each of pedestals 102*a*, 102*b* can be used in several different modes to detect a marker tag exciter signal. These modes will be described below in further detail.

Figure 3A:
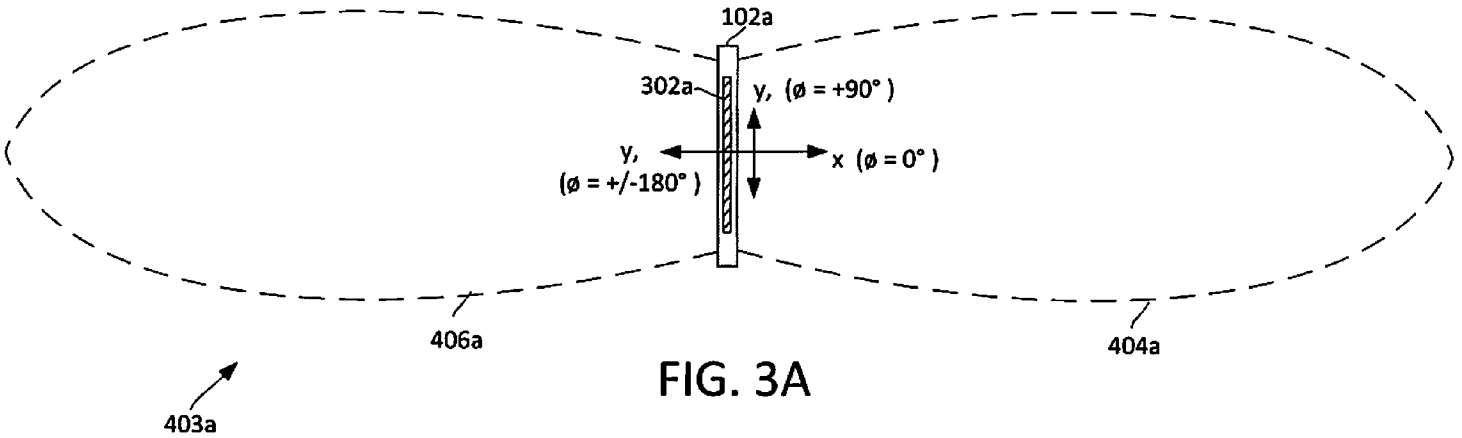
FIGS. 3A and 3B are drawings which are useful for understanding a main field and a backfield of antennas which are used in an EAS system.
Figure 3B:
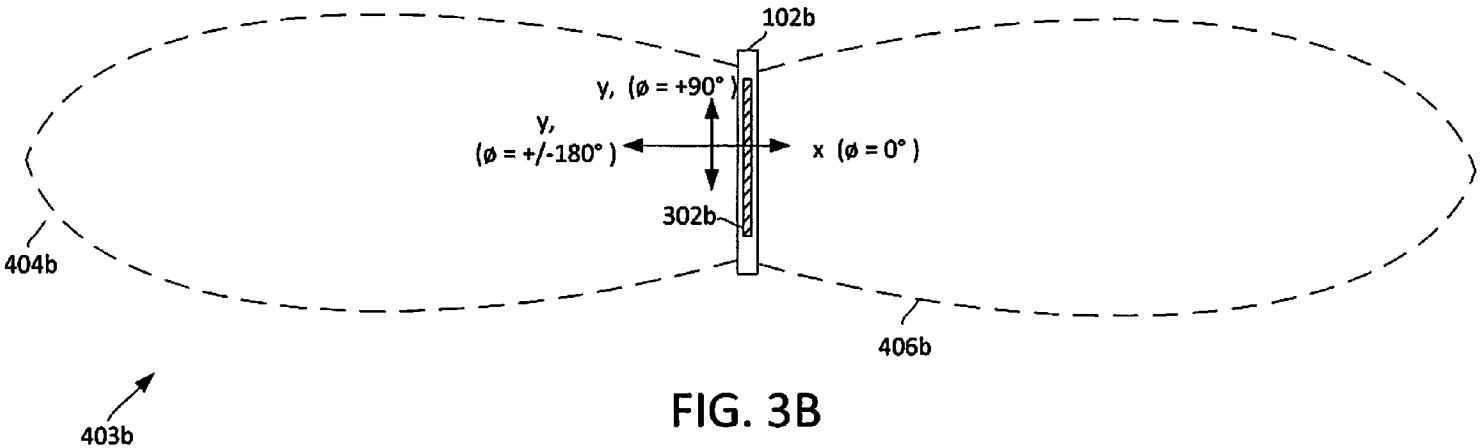

Referring now to FIGS. 3A and 3B, there are shown exemplary antenna field patterns 403*a*, 403*b* for antennas 302*a*, 302*b* contained in pedestal 102*a*, 102*b*. As is known in the art, an antenna radiation pattern is a graphical representation of the radiating (or receiving) properties for a given antenna as a function of space. The properties of an antenna are the same in transmit and receive mode of operation and so the antenna radiation pattern shown is applicable for both transmit and receive operations as described herein. The exemplary antenna field patterns 403*a*, 403*b* shown in FIGS. 3A, 3B are azimuth plane pattern representing the antenna pattern in the x, y coordinate plane. The azimuth pattern is represented in polar coordinate form and is sufficient for understanding the inventive arrangements. The azimuth antenna field patterns shown in FIGS. 3A and 3B are a useful way of visualizing the direction in which the antennas 302*a*, 302*b* will transmit and receive signals at a particular power level.

Figure 4A:
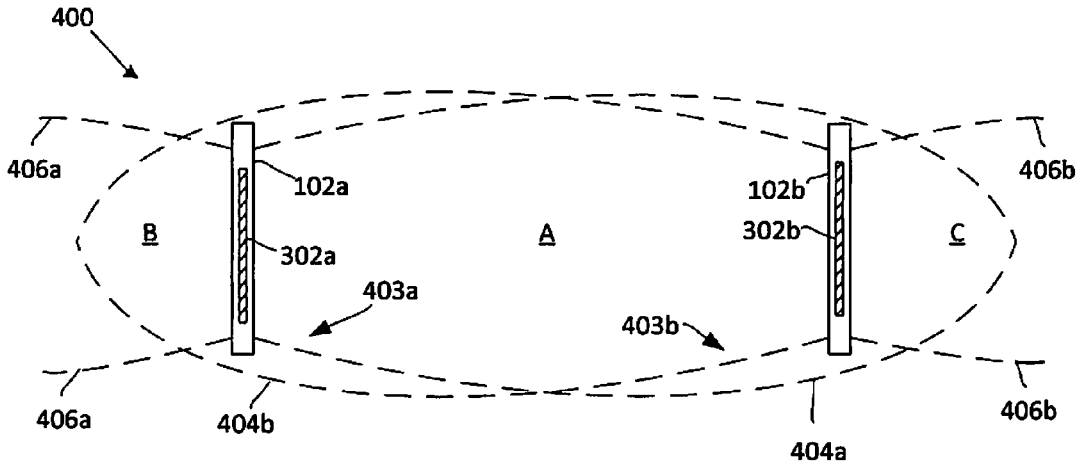
FIG. 4A is a drawing which is useful for understanding a detection zone in a non-idealized EAS detection system.

The antenna field pattern 403*a*, 403*b* shown in FIG. 3A includes a main lobe 404*a* with a peak at ø=0° and a backfield lobe 406*a* with a peak at angle ø=180°. Conversely, the antenna field pattern 403*b* shown in FIG. 3B includes a main lobe 404*b* with its peak at ø=180° and a backfield lobe 406*b* with a peak at angle ø=0°. In an EAS system, each pedestal is positioned so that the main lobe of an antenna contained therein is directed into a detection zone (e.g. detection zone 108). Accordingly, a pair of pedestals 102*a*, 102*b* in an EAS system 400 shown in FIG. 4A will produce overlap in the antenna field patterns 403*a*, 403*b* as shown. Notably, the antenna field patterns 403*a*, 403*b* shown in FIG. 4A are scaled for purposes of understanding the invention. In particular, the patterns show the outer boundary or limits of an area in which an exciter signal of particular amplitude applied to antennas 302*a*, 302*b* will produce a detectable response in an EAS marker tag. The significance of this scaling will become apparent as the discussion progresses. However, it should be understood that a marker tag within the bounds of at least one antenna field pattern 403*a*, 403*b* will generate a detectable response when stimulated by an exciter signal.

The overlapping antenna field patterns 403*a*, 403*b* in FIG. 4A will include an area A where there is overlap of main lobes 404*a*, 404*b*. However, it can be observed in FIG. 4A that there can also be some overlap of a main lobe of each pedestal with a backfield lobe associated with the other pedestal. For example, it can be observed that the main lobe 404*b* overlaps with the backfield lobe 406*a* within an area B. Similarly, the main lobe 404*a* overlaps with the backfield lobe 406*b* in an area C. Area A between pedestals 102*a*, 102*b* defines a detection zone in which active marker tags should cause an EAS system 400 to generate an alarm response. Marker tags in area A are stimulated by energy associated with an exciter signal within the main lobes 404*a*, 404*b* and will produce a response which can be detected at each antenna. The response produced by a marker tag in area A is detected within the main lobes of each antenna and processed in a system controller 110. But note that a marker tag in areas B or C will also be excited by the antennas 302*a*, 302*b*, and the response signal produced by a marker tag in these areas B and C will also be received at one or both antennas. This condition is not desirable because it can produce EAS alarms at system controller 110 when there is in fact no marker present within the detection zone between the pedestals. Accordingly, a method will now be described which is useful for determining when a detected marker tag is within a backfield zone (area B or area C) as opposed to a detection zone (area A). The process described herein is advantageous as it can be implemented in a detection system 400 by simply updating the software in system controller 110 without modifying any of the other hardware elements associated with the system.

Figure 5:
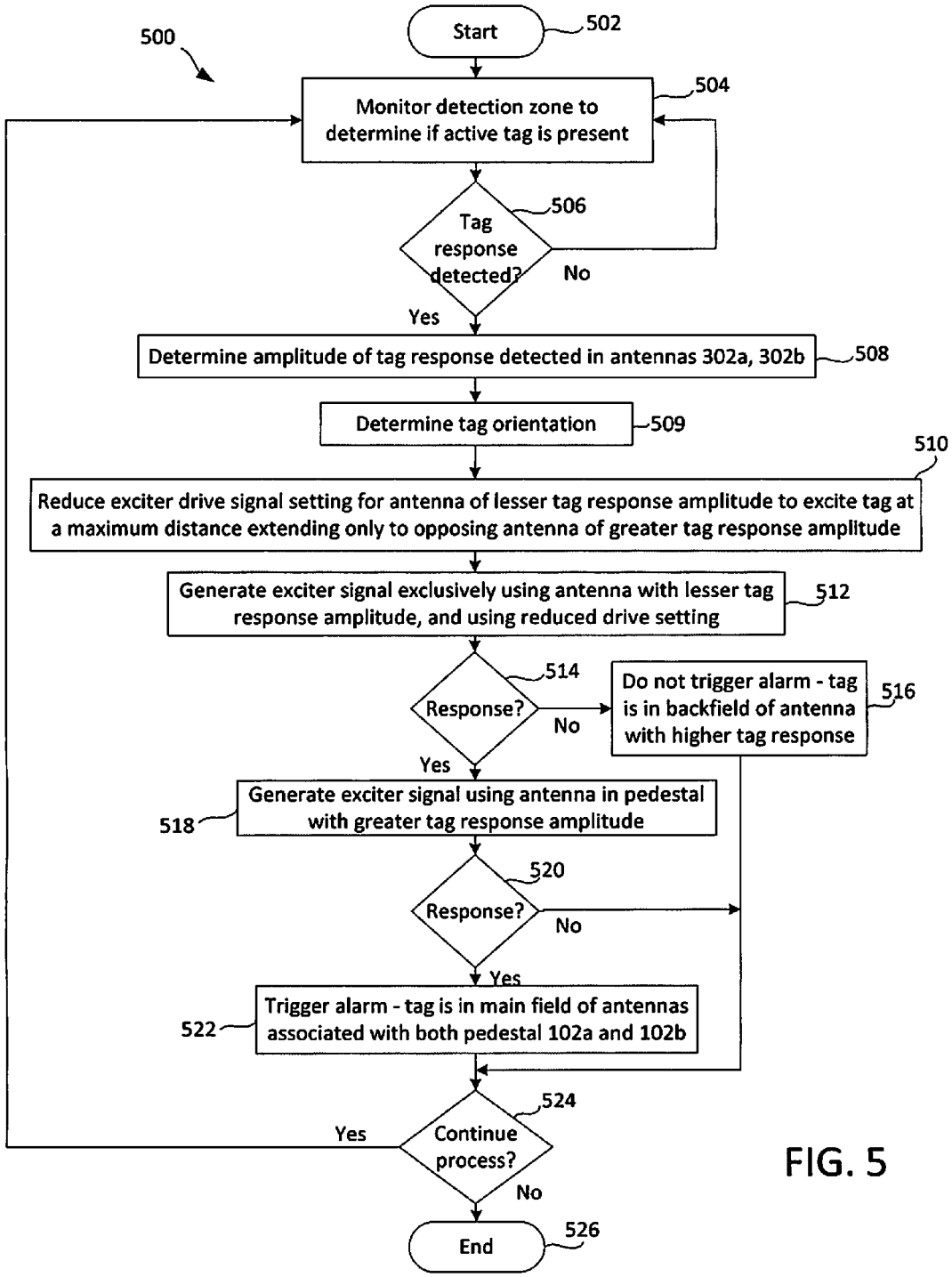
FIG. 5 is a flowchart that is useful for understanding and embodiment of the invention.

Referring now to FIG. 5 there is provided a flowchart that is useful for understanding the inventive arrangements. The flowchart describes an inventive algorithm that compares the amplitude of the tag response captured in antennas 302*a*, 302*b*, and then uses that information to prevent undesired alarms caused by marker tags present in the backfield lobes 406*a*, 406*b* of an antenna.

The process begins at 502 and continues to 504 where the detection zone (e.g. area A) is monitored to determine if an active marker tag is present. For purposes of the present invention, the monitoring at 504 can be performed in accordance with one or more different operating modes. For example, in a first operating mode the antennas 302*a*, 302*b* are excited simultaneously using an appropriate exciter signal and the responsive signal produced by the marker tag is then detected by receiving circuitry respectively associated with each of the antennas. In a second mode, an antenna at a first one of the pedestals (e.g. antenna 302*a*) transmits an exciter signal and the responsive signal produced by the marker tag is detected by receiver circuitry associated with the antenna (e.g. antenna 302*b*) in the second one of the pedestals. In a third operating mode an antenna (e.g. antenna 302*b*) at the second of the pedestals transmits an exciter signal and the responsive signal produced by the marker tag is detected by receiver circuitry associated with the antenna in the first one of the pedestals (e.g. antenna 302*a*).

In one embodiment of the invention, only one of the operating modes described herein is used for the monitoring purposes at step 506. However, in other embodiments, the monitoring step can include cycling through two or more of the different operating modes before the process continues at step 506. Due to the fact that an EAS marker tag 112 may not be located in the exact center between the two pedestals 102*a*, 102*b* the, amplitude of the response signal may be different at the antennas respectively associated with pedestals 102*a*, 102*b*, and can vary in amplitude depending on which pedestal has transmitted the exciter signal. The various operating modes as described herein can be useful for confirming the presence of an active marker tag.

At 506 a determination is made as to whether an active tag has been detected. This determination can be made based on detection of an EAS marker signal response at antenna 302*a*, antenna 302*b*, or both antennas. The determination is made by system controller 110 using techniques which are well known and therefore will not be described here in detail. If no response has been detected (506: No), the process returns to 504 and monitoring for active tags in the detection zone 108 continues. If it is determined at 506 that an active tag has been detected (506: Yes) by at least one of the antennas 302*a*, 302*b* then the process continues to 508. At this point, an alarm flag can also be set by the system to indicate that an EAS alarm condition may exist.

A determination is made at 508 as to the amplitude of contemporaneous tag responses detected at antennas 302*a*, 302*b*. These contemporaneous responses are preferably obtained by generating an exciter signal field using antennas in both pedestals and then monitoring the tag response at both pedestals. Still, the invention is not limited in this regard and it possible for the contemporaneous responses to be generated by an exciter signal field which is generated by only one pedestal, and then detecting the tag response at both pedestals. When an active marker tag is present in the detection zone, the contemporaneous tag response detected by one pedestal will generally be greater than or less than the response detected in the other pedestal.

Figure 4B:
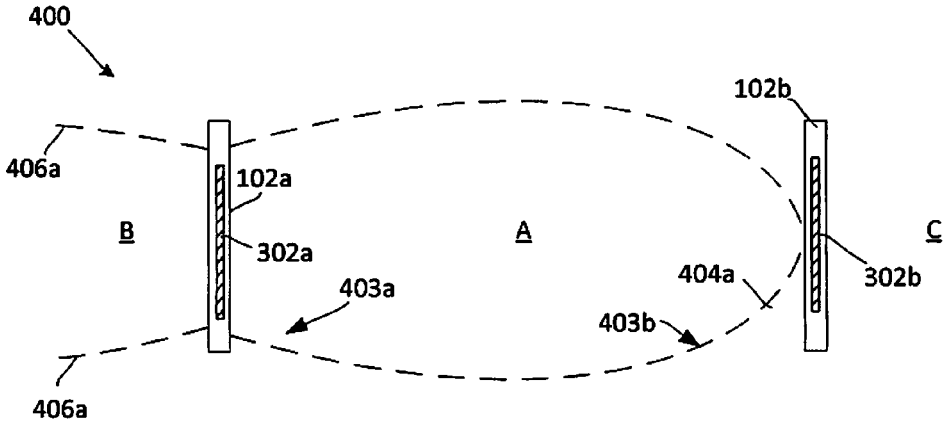
FIG. 4B is a drawing which is useful for understanding a detection zone in an EAS system where an exciter drive signal has been reduced in one of two pedestals.

Step 509 is an optional step which involves determining orientation of a detected EAS marker tag. Step 509 will be discussed below in further detail in relation to FIG. 7. Following step 509, the process continues to 510 where an exciter drive signal setting is selected or adjusted. More particularly, the exciter drive signal is selectively reduced for the antenna in the pedestal having the lesser of the detected tag response amplitudes. The exciter drive signal for that antenna is reduced so that when the drive signal is applied to the particular antenna 302*a*, 302*b* it is capable of producing a detectable marker tag response in tags located at a maximum distance which does not extend beyond the plane of the opposing antenna. This concept will be described in further detail below, but is illustrated in FIG. 4B which shows a scenario in which the exciter drive signal applied to antenna 302*a* has been reduced.

Once the lower drive signal setting is established for the pedestal in which a lesser tag response is detected, the process continues in step 512. At 512, an exciter drive signal is applied exclusively to the antenna where the lesser tag response was detected, and using the reduced exciter drive signal. For example, if the lesser tag response was detected in pedestal 102*a*, then the reduced amplitude exciter drive signal would be applied to antenna 302*a*. The reduced amplitude exciter drive signal will produce a field that is capable of exciting marker tags in the main lobe of the antenna up to the distance of the opposing antenna, and no further. This concept is illustrated in FIG. 4B. Note that as a result of the reduction in exciter drive signal, the antenna pattern 403*a* is reduced in scale to show that it does not extend beyond the plane of the antenna 302*b*. This is intended to illustrate that the field is not capable of producing a detectable marker tag response at a distance beyond the plane of antenna 302*b*.

A reduced amplitude drive signal applied at a first one of the antennas (e.g. at antenna 302*a*) should result in no detectable marker tag response if the marker is in the backfield of the opposing antenna (e.g. 302*b*). Therefore the absence of a detectable marker tag response at 514 can be used as a basis to conclude that the marker tag is not present in the detection zone (area A). For example, in the scenario shown in FIG. 4B, the absence of a detectable marker tag response can be used as a basis to conclude that the marker tag must be present in the backfield of antenna 302*b* (i.e. in area B) rather than in the detection zone (area A).

If no response is detected at 514 (514: No), the process continues to 516 where the previously set alarm flag is disabled or cancelled. The alarm is disabled because the absence of response under the conditions described is understood to mean that the marker tag is in a backfield of the opposing antenna (in the backfield of antenna 302*b* in this example). Accordingly, an EAS alarm is advantageously cancelled or inhibited.

Conversely, if a response is detected at 514 (514: Yes) then it can be concluded that an EAS tag is present in the detection zone between the pedestals. At this point, a previously set alarm tag is validated and the process could simply cause an EAS alarm to be generated at 522. However, as a precautionary measure to prevent undesired alarms, it can be advantageous to subsequently confirm the presence of the EAS tag in the detection zone. For example, this can be accomplished at optional step 518 by applying an exciter drive signal to the antenna contained in the pedestal which had the greater amplitude tag response. This pedestal having a higher amplitude response can be determined using the response amplitude information as previously obtained at 508. Alternatively, a drive signal could be applied simultaneously to the antennas at both of pedestals 102*a*, 102*b*. Thereafter, at 520, a determination is made as to whether an EAS marker tag response has been detected at one or both of the antennas 302*a*, 302*b*. For example, if the EAS exciter drive signal is applied only to pedestal 302*b*, then the EAS marker tag response signal could be detected at pedestal 302*a*. Still, the invention is not limited in this regard and other confirmation methods can be used.

If an active EAS marker tag response is detected at 520 (520: yes) then the process will continue to step 522 where an EAS alarm is triggered. The presence of the marker tag in the detection zone between the pedestals is assured based on the foregoing processing steps. At 524 a determination can be made as to whether the EAS monitoring process should continue, and if so (524: Yes) then the process will return to 504. If processing is complete or the system is to be shut down, the process will end at 526.

It will be appreciated that the inventive arrangements described herein will require precise calibration of exciter drive signal power levels to ensure that the scenario shown in FIG. 4B is achieved. In particular, the reduced amplitude exciter drive signal referenced in relation to step 510 must be calibrated to produce a field that is capable of exciting marker tags in the main lobe of the antenna up to the distance of the opposing antenna, and no further. If the exciter drive signal is reduced too much, an electromagnetic field of required intensity may not extend fully to the opposing pedestal. In that case the exciter drive signal may fail to excite an active EAS marker tag in the detection zone (area A), particularly if the EAS tag is very close to the opposing pedestal. Conversely, if the exciter signal is not reduced enough, the electromagnetic exciter signal field produced by the exciter drive signal may extend into the backfield area of the opposing antenna. In that case, the exciter signal may inadvertently produce a response from an EAS marker tag which is not contained in the detection zone. Accordingly, the correct power setting for the reduced amplitude exciter drive signal is an important factor for purposes of ensuring proper system operation.

One problem with determining the correct reduced amplitude drive signal setting to be applied in step 510 is related to EAS marker tag orientation. Notably, the intensity of the RF field required to produce a detectable response from an EAS marker tag can vary in accordance with the orientation of the tag relative to the antennas 302*a*, 302*b*. This means that the correct reduced amplitude drive signal setting applied in step 510 will vary depending on the physical orientation of the marker tag which is present. Accordingly, it can be useful to have information concerning tag orientation for purposes of selecting the reduced amplitude drive signal setting. This information is optionally obtained at step 509.

Figure 6A:
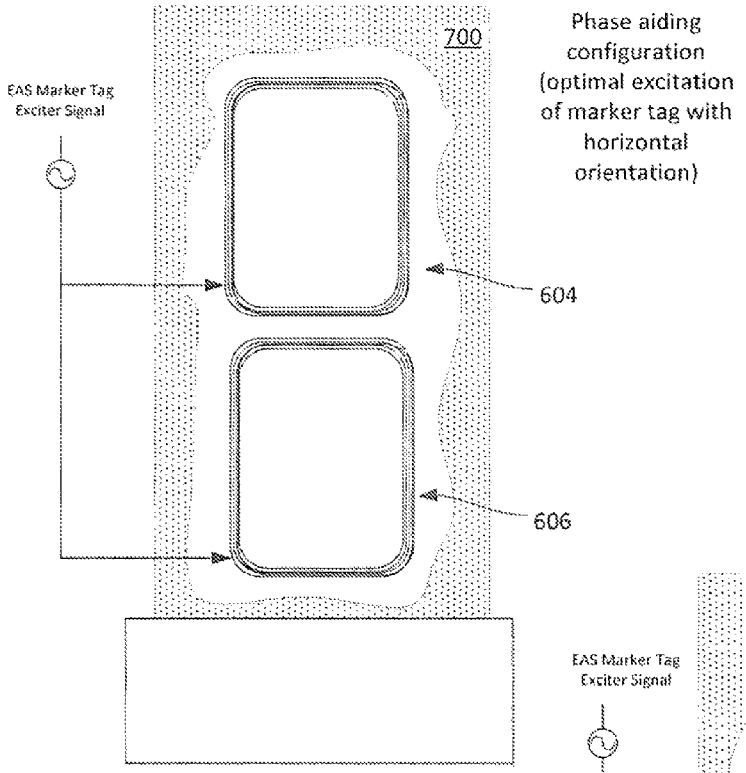
FIGS. 6A and 6B are partial cutaway views of a pedestal showing a pair of exciter coils that are useful for understanding a phase aiding and phase opposed configuration for exciter signals applied at the pedestal.
Figure 6B:
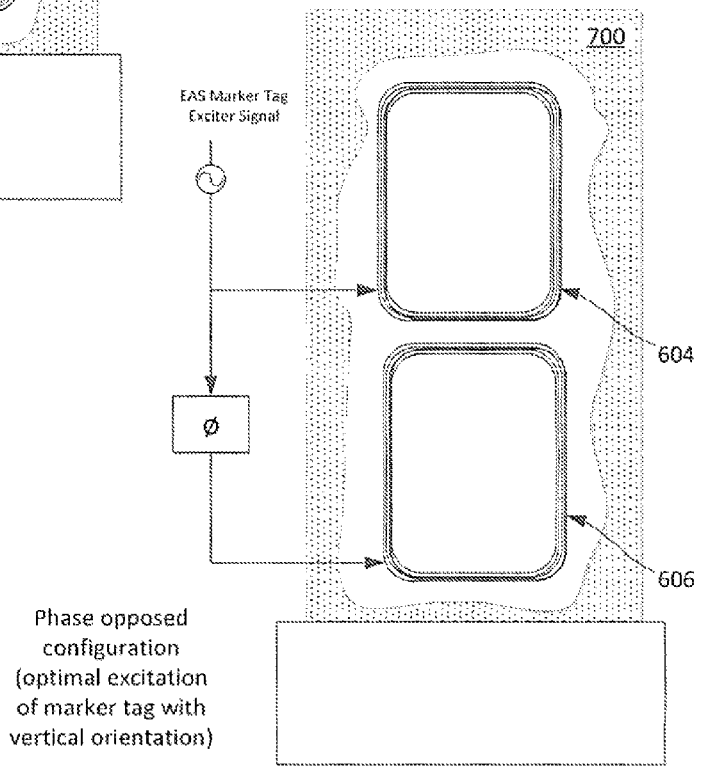

Marker tag orientation can be discerned by strategically varying the phase of individual exciter coils (antennas) in a pedestal and monitoring the associated signal response produced by a marker tag. A marker tag having an elongated length aligned substantially in a horizontal orientation (i.e., aligned along the x axis in FIG. 1, transverse to the vertical orientation of the antennas and pedestals) is optimally excited by a "phase aiding" configuration in which the upper and lower antennas or exciter coils are excited in phase. This concept is illustrated in FIG. 6A which shows a partial cutaway view of a pedestal 600 comprising an upper exciter coil 604 and a lower exciter coil 606 which are excited in phase. Conversely, a marker tag having an elongated length aligned substantially with a vertical orientation (i.e. aligned with the z axis in FIG. 1, parallel to the vertical orientation of the antennas) is optimally excited by a "phase opposed" configuration wherein the upper and lower exciter coils are excited out of phase. For example, the signals applied to the upper and lower exciter coils can be approximately 180° out of phase (ø=180°). Still, the invention is not limited in this regard and other phase relationships are also possible. The phase opposed configuration is illustrated in FIG. 6*b*. The different response characteristics can be used to determine a marker tag orientation as described below in FIG. 7.

Figure 7:
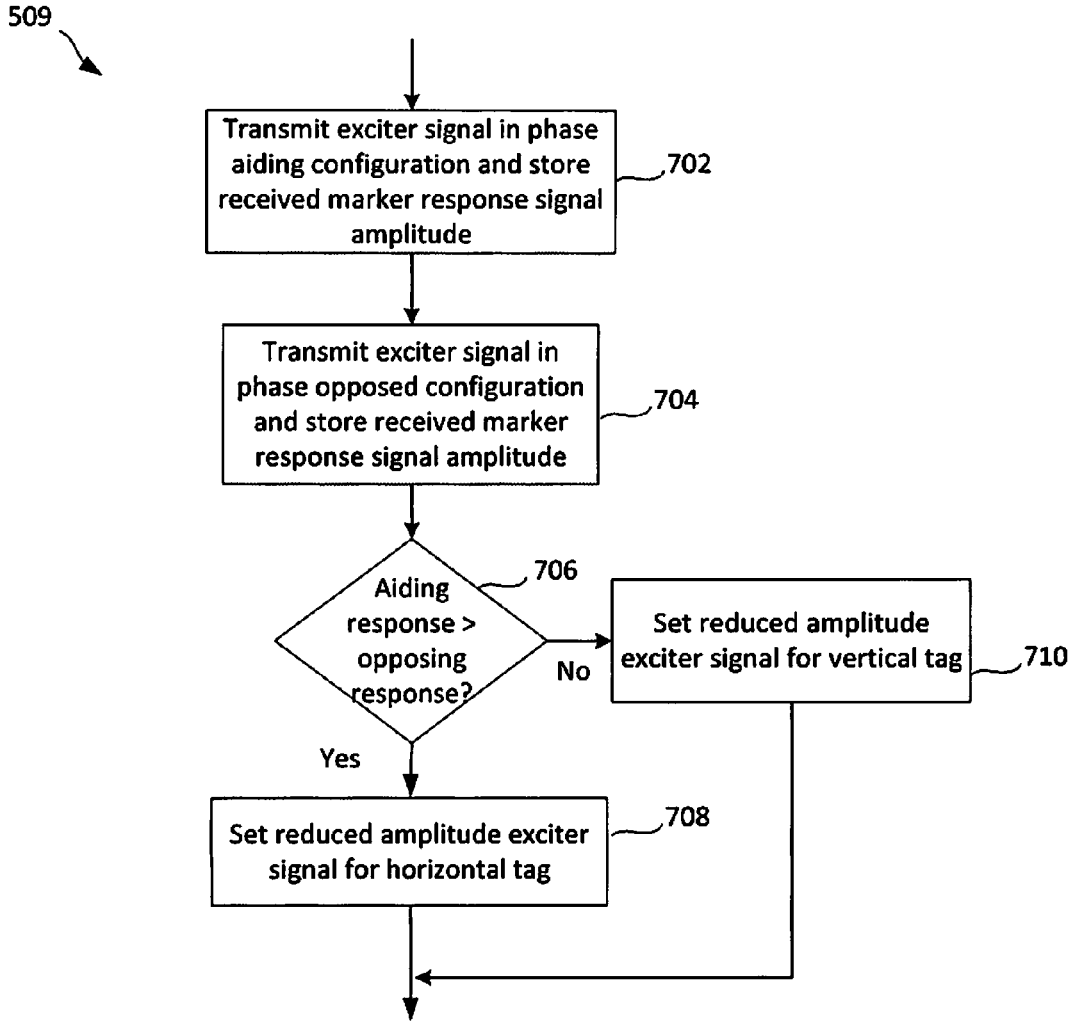
FIG. 7 is a flowchart that is useful for understanding an optional process for determining EAS marker tag orientation.

The flowchart shown in FIG. 7 provides an exemplary set of steps which are useful for understanding how an orientation of a marker tag can be discerned in step 509. Once determined, this information can be used to select an optimal or correct reduced amplitude exciter drive signal for use at steps 510 and 512. The process of determining orientation can begin at 702 by transmitting a tag exciter signal from the pedestal where the lesser tag response was detected in accordance with the comparison of step 508. For example, if the lesser tag response was detected in pedestal 102*a*, then the tag exciter signal is applied to antenna 302*a*. The tag exciter signal is applied to an upper and lower antenna (exciter coils) in a phase aiding configuration similar to that shown in FIG. 6A. The resulting response from the marker tag is then sensed at the antenna in the opposing pedestal (e.g. pedestal 302*b* in this example) and the received signal amplitude is stored by the controller 110.

The process then continues on to step 704 by again transmitting a tag exciter signal from the pedestal where the lesser tag response was originally detected at 508. The tag exciter signal drive level is advantageously chosen to be the same as the level used at step 704, but the signal is applied to the upper and lower antennas in a phase opposed configuration similar to that shown in FIG. 6B. The signal response produced by the marker tag is sensed by the antenna in the opposing pedestal and the amplitude value is again stored.

At 706, a determination is made as to whether the measured amplitude response received from the marker tag at steps 702, 704 was greater in the phase aiding configuration or phase opposed configuration. If the detected response was greater in the phase aiding configuration then it can be concluded that the marker tag is substantially in the horizontal orientation. Accordingly, the reduced exciter drive signal setting is selected to correspond to a horizontally oriented tag at 708. Conversely, if the detected response was greater in the phase opposed configuration, then it can be concluded that the marker tag is substantially in the vertical orientation. In that case, the reduced exciter drive signal setting is selected to correspond to a vertically oriented tag at 710. In either scenario, the actual orientation of the marker tag may not be precisely vertical or horizontal. However, the orientation sensing process will provide a useful indication of a setting for a reduced amplitude exciter drive signal for use at steps 510 and 512.

Figure 8:
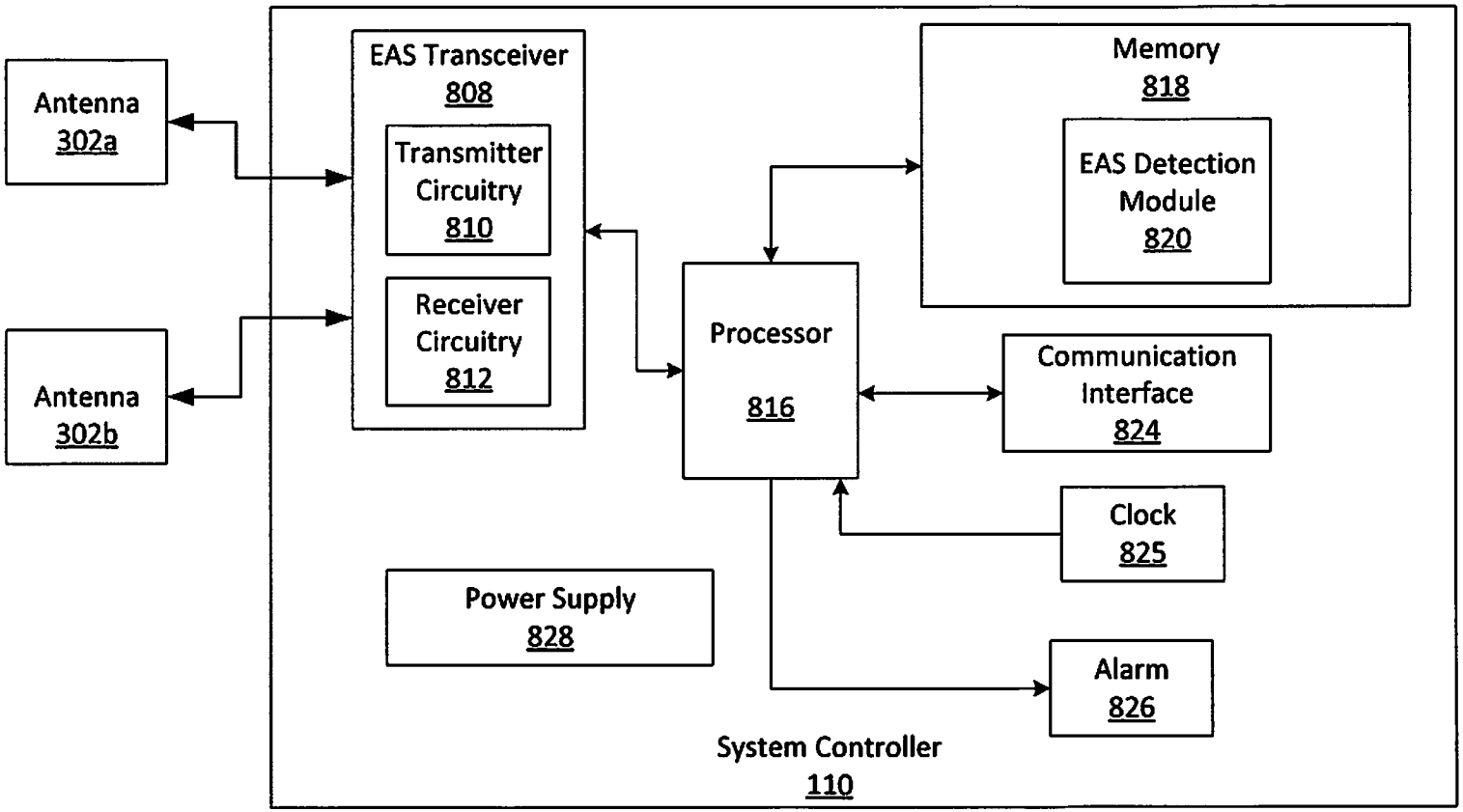
FIG. 8 is a block diagram that is useful for understanding an arrangement of an EAS controller which is used in the EAS detection system of FIG. 1.

Referring now to FIG. 8, there is provided a block diagram that is useful for understanding the arrangement of the system controller 110. The system controller comprises a processor 816 (such as a micro-controller or central processing unit (CPU)). The system controller also includes a computer readable storage medium, such as memory 818 on which is stored one or more sets of instructions (e.g., software code) configured to implement one or more of the methodologies, procedures or functions described herein. The instructions (i.e., computer software) can include an EAS detection module 820 to facilitate EAS detection and perform backfield reduction for reducing undesired alarms as described herein. These instructions can also reside, completely or at least partially, within the processor 816 during execution thereof.

The system also includes at least one EAS transceiver 808, including transmitter circuitry 810 and receiver circuitry 812. The transmitter and receiver circuitry are electrically coupled to antenna 302*a* and the antenna 302*b*. A suitable multiplexing arrangement can be provided to facilitate both receive and transmit operation using a single antenna (e.g. antenna 302*a* or 302*b*). Transmit operations can occur concurrently at antennas 302*a*, 302*b* after which receive operations can occur concurrently at each antenna to listen for marker tags which have been excited. Alternatively, transmit operations can be selectively controlled as described herein so that only one antenna is active at a time for transmitting marker tag exciter signals for purposes of executing the various algorithms described herein. The antennas 302*a*, 302*b* can include an upper and lower antenna similar to those shown and described with respect to FIGS. 6A and 6B. Input exciter signals applied to the upper and lower antennas can be controlled by transmitter circuitry 810 or processor 816 so that the upper and lower antennas operate in a phase aiding or a phase opposed configuration as required.

Additional components of the system controller 110 can include a communication interface 824 configured to facilitate wired and/or wireless communications from the system controller 110 to a remotely located EAS system server. The system controller can also include a real-time clock, which is used for timing purposes, an alarm 826 (e.g. an audible alarm, a visual alarm, or both) which can be activated when an active marker tag is detected within the EAS detection zone 108. A power supply 828 provides necessary electrical power to the various components of the system controller 110. The electrical connections from the power supply to the various system components are omitted in FIG. 8 so as to avoid obscuring the invention.

Those skilled in the art will appreciate that the system controller architecture illustrated in FIG. 8 represents one possible example of a system architecture that can be used with the present invention. However, the invention is not limited in this regard and any other suitable architecture can be used in each case without limitation. Dedicated hardware implementations including, but not limited to, application-specific integrated circuits, programmable logic arrays, and other hardware devices can likewise be constructed to implement the methods described herein. It will be appreciated that the apparatus and systems of various inventive embodiments broadly include a variety of electronic and computer systems. Some embodiments may implement functions in two or more specific interconnected hardware modules or devices with related control and data signals communicated between and through the modules, or as portions of an application-specific integrated circuit. Thus, the exemplary system is applicable to software, firmware, and hardware implementations.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A method for a reduction in backfield alarms in an electronic article surveillance (EAS) system having at least two transceiver pedestals defining a detection zone between the pedestals, comprising:

measuring a tag response at a first pedestal and at a second pedestal to obtain contemporaneous first and second tag responses, the first and second tag responses respectively associated with the first and second pedestals;

comparing the first and second tag responses to evaluate their relative signal strength and thereby discern a lesser signal strength tag response;

setting a reduced level exciter drive signal for a selected one of the first and second pedestals associated with the lesser signal strength tag response;

using the reduced level exciter drive signal at the pedestal associated with the lesser signal strength tag response to produce an electromagnetic exciter field in said detection zone;

monitoring to determine the occurrence of a third tag response resulting from the reduced level exciter signal; and determining the approximate location of the tag in relation to the first and second pedestals based on the first, second, and third tag responses, wherein said reduced level exciter drive signal is reduced in power level as compared to an exciter signal used to obtain said contemporaneous first and second tag responses.

2. The method of claim 1, further comprising:

setting an alarm event flag when the first and second tag responses are detected;

validating the alarm event if the tag is determined to be inside the detection zone between the first and second pedestals; and triggering an alarm if the alarm event has been validated.

3. The method of claim 1, further comprising:

setting an alarm event flag when the first and second tag responses are detected; and disabling the alarm event flag if it is determined that the tag is outside of the detection zone between the first and second pedestals to prevent the triggering of an alarm.

4. The method of claim 1, further comprising determining an approximate physical orientation of the tag.

5. The method of claim 4, further comprising selectively determining said reduced level drive signal based on said approximate physical orientation of the tag.

6. The method of claim 4, wherein at least one of said first and second pedestals comprises a first exciter coil and a second exciter coil and said approximate physical orientation of the tag is determined by selectively controlling a relative phase of an exciter drive signal applied to said first and second exciter coils respectively.

7. The method of claim 1, wherein said comparing step further comprises determining which of said pedestals has a greater signal strength tag response, and further comprising selecting said reduced level exciter drive signal to produce a detectable exciter tag response at a distance which extends up to the pedestal associated with the greater signal strength tag response and no further.

8. The method of claim 7, wherein said reduced level drive signal is determined based on a comparative analysis of a signal response produced by said tag in the presence of a first electromagnetic field pattern and a second electromagnetic field pattern different from the first electromagnetic field pattern.

9. The method of claim 8, wherein said first and second electromagnetic field patterns are produced by selectively controlling a relative phase of an orientation discerning exciter signal applied to a first and a second exciter coil in a pedestal, and comparing first and second amplitude levels of signal responses produced by said tag in the presence of said first and second electromagnetic field patterns.

10. The method of claim 9, wherein said orientation discerning exciter signal is applied to said first and second exciter coils in said pedestal associated with the lesser signal strength tag response.

11. The method of claim 10, wherein said amplitude levels of the signal response produced by said tag in the presence of said first and second electromagnetic field patterns is detected at the pedestal associated with the greater signal strength tag response.

12. An electronic article surveillance (EAS) system having at least two transceiver pedestals defining a detection zone between the pedestals, comprising:

first and second pedestals, each including at least one exciter coil;

a transmitter configured to generate exciter signals which, when applied to at least one of said exciter coils, produce response signals from tags present in the detection zone;

at least one receiver configured to receive said response signals; and at least one processor configured to determine a tag response received at said first pedestal and at said second pedestal to obtain contemporaneous first and second tag responses, the first and second tag responses respectively associated with the first and second pedestals;

compare the first and second tag responses to evaluate their relative signal strength and thereby determine a lesser signal strength tag response;

set a reduced level exciter drive signal for a selected one of the first and second pedestals associated with a lesser signal strength tag response;

cause the reduced level exciter drive signal to be applied to said at least one exciter coil at the pedestal associated with the lesser signal strength tag response to produce an electromagnetic exciter field in said detection zone;

monitor an output of said at least one receiver to determine the occurrence of a third tag response resulting from the reduced level exciter signal; and determine the approximate location of the tag in relation to the first and second pedestals based on the first, second, and third tag responses, wherein said reduced level exciter drive signal is reduced in power level by said processor as compared to an exciter signal used to obtain said contemporaneous first and second tag responses.

13. The system of claim 12, wherein said processor is further configured to:

set an alarm event flag when the first and second tag responses are detected;

validate the alarm event if the tag is determined to be inside the detection zone between the first and second pedestals; and trigger an alarm if the alarm event has been validated.

14. The system of claim 12, wherein said processor is further configured to:

set an alarm event flag when the first and second tag responses are detected; and disable the alarm event flag if it is determined that the tag is outside of the detection zone between the first and second pedestals to prevent the triggering of an alarm.

15. The system of claim 12, wherein said processor is further configured to determine an approximate physical orientation of the tag.

16. The system of claim 15, wherein said processor is further configured to selectively determine said reduced level drive signal based on said approximate physical orientation of the tag.

17. The system of claim 15, wherein at least one of said first and second pedestals comprises a first exciter coil and a second exciter coil and wherein said processor is further configured to determine said approximate physical orientation of the tag by selectively controlling a relative phase of an exciter drive signal applied to said first and second exciter coils respectively.

18. The system of claim 12, wherein said processor is further configured to determine which of said pedestals has detected a greater signal strength tag response, and to said reduced level exciter drive signal to produce a detectable exciter tag response at a distance which extends up to the pedestal associated with the greater signal strength tag response and no further.

19. The system of claim 18, wherein said processor is configured to determine said reduced level drive signal based on a comparative analysis of a signal response produced by said tag in the presence of a first electromagnetic field pattern and a second electromagnetic field pattern different from the first electromagnetic field pattern.

20. The system of claim 19, wherein said processor is further configured to cause said first and second electromagnetic field patterns to be produced by selectively controlling a relative phase of an orientation discerning exciter signal applied to a first and a second exciter coil in one of said first and second pedestals, and to compare first and second amplitude levels of signal responses produced by said tag in the presence of said first and second electromagnetic field patterns.

21. The system of claim 20, wherein said processor is further configured to cause said orientation discerning exciter signal to be applied to said first and second exciter coils in said pedestal associated with the lesser signal strength tag response.

22. The system of claim 21, wherein said processor is further configured to detect said amplitude levels of the signal response produced by said tag in the presence of said first and second electromagnetic field patterns at the pedestal associated with the greater signal strength tag response.

* * * * *